United States Patent [19]

Lohman

[11] 4,320,013

[45] Mar. 16, 1982

[54] FABRIC CONDITIONING COMPOSITIONS

[75] Inventor: Frederick H. Lohman, Cincinnati, Ohio

[73] Assignee: The Procter & Gamble Company, Cincinnati, Ohio

[21] Appl. No.: 158,088

[22] Filed: Jun. 10, 1980

[51] Int. Cl.[3] ..... D06M 13/46

[52] U.S. Cl. ..... 252/8.8

[58] Field of Search ..... 252/8.8

[56] References Cited

U.S. PATENT DOCUMENTS

| | | | |
|---|---|---|---|
| 3,154,489 | 11/1964 | DuBrow et al. | 252/8.75 |
| 3,904,533 | 9/1975 | Neiditch et al. | 252/8.8 |
| 4,076,632 | 2/1978 | Davis | 252/8.8 |
| 4,128,484 | 12/1978 | Barford et al. | 252/8.8 |
| 4,157,307 | 6/1979 | Jaeger et al. | 252/8.8 |
| 4,233,164 | 11/1980 | Davis | 252/8.8 |

FOREIGN PATENT DOCUMENTS 781187 10/1979 South Africa .

*Primary Examiner*—Maria Parrish Tungol

*Attorney, Agent, or Firm*—Ronald L. Hemingway; Richard C. Witte

[57] ABSTRACT

Aqueous fabric conditioning compositions having improved freeze-thaw recovery properties, said compositions comprising a fabric conditioning component which can be a water-insoluble cationic fabric conditioning agent or a mixture of water-insoluble cationic and nonionic fabric conditioning agents; and a freeze-thaw recovery component which is a mixture of an ethoxylated monohydrocarbyl amine and a water-soluble quaternary ammonium salt.

7 Claims, No Drawings

FABRIC CONDITIONING COMPOSITIONS

TECHNICAL FIELD

This invention relates to aqueous compositions for conditioning fabrics during the rinse cycle of home laundering operations. This is a widely used practice to impart to laundered fabrics a texture or handle that is smooth, pliable and fluffy to the touch (i.e. soft) and also to impart to the fabrics a reduced tendency to pick up and/or retain an electrostatic charge (i.e. static control), especially when the fabrics are dried in an automatic dryer. Both of these concepts are included within the term "fabric conditioning" as used in this application.

It has become commonplace today for homemakers to use fabric conditioning compositions comprising major amounts of water, lesser amounts of fabric conditioning agents, and minor amounts of optional ingredients such as perfumes, colorants, preservatives and stabilizers. Such compositions are aqueous suspensions or emulsions which can be conveniently added to the rinsing bath of home laundering operations.

BACKGROUND ART

Liquid fabric conditioning compositions to be used in the home laundering of fabrics are conventionally aqueous dispersions containing from about 3% to about 10% by weight of a water-insoluble cationic fabric conditioner or mixture of such cationic conditioners or mixtures of one or more of such cationic conditioners with a water-insoluble nonionic fabric conditioner such as a fatty ester. Such compositions must be formulated carefully in order to insure that the compositions will remain in a single phase condition during long periods of storage. In addition to phase stability, another problem with aqueous fabric conditioning compositions is freeze-thaw recovery, i.e., the ability to recover to a pourable liquid state upon warming to or slightly above room temperature after having been frozen. U.S. Pat. No. 3,904,533, Neiditch, issued Sept. 9, 1975 discloses the use of $C_{10}$–$C_{14}$ alkyl trimethyl ammonium chlorides as agents to improve freeze-thaw recovery in fabric conditioning compositions which contain water-insoluble quaternary ammonium salts as the conditioning agent. U.S. Pat. No. 4,157,307 Jaeger et al, issued June 5, 1979 discloses the use of the combination of a di-polyethoxy monoalkylamine and a lower alcohol to improve the freeze-thaw recovery of an aqueous cationic fabric conditioner system which is a combination of a dialkyl dimethyl ammonium chloride and a quaternary imidazolinium salt. There is a continuing need for freeze-thaw recovery agents for aqueous fabric softening compositions.

SUMMARY OF THE INVENTION

The present invention relates to fabric conditioning compositions in liquid form for use in home laundry operations. These compositions comprise three essential components: a substantially water-insoluble fabric conditioning component, which can be a cationic fabric conditioning agent selected from a specific group of such cationic agents and mixtures thereof, or a mixture of cationic and nonionic fabric conditioning agents, and a freeze-thaw recovery component which is a mixture of a water-soluble quaternary ammonium surfactant which is a mono-long chain ($C_{14}$–$C_{22}$) hydrocarbyl tri-short chain ($C_1$–$C_3$) alkyl ammonium salt and a water-soluble, di-polyethoxy mono-hydrocarbyl amine.

The weight ratio of the fabric conditioning agent(s) to the freeze-thaw recovery component is from about 3:1 to about 10:1 and the weight ratio of the ethoxylated amine to the water-soluble quaternary ammonium salt is from about 0.4:1 to about 2:1. All percentages and ratios herein are "by weight" unless specified otherwise. The term "hydrocarbyl" as used herein means an aliphatic radical which can be alkyl or alkenyl.

DETAILED DESCRIPTION OF THE INVENTION

The present invention relates to the discovery that mixtures of certain water-soluble quaternary ammonium salts and water-soluble di-polyethoxy mono-hydrocarbyl amines are highly effective in improving the freeze-thaw recovery behavior of aqueous fabric conditioning compositions which utilize certain water-insoluble cationics or combinations of such water-insoluble cationics and water-insoluble nonionics as the fabric conditioning agent.

The aqueous fabric conditioning compositions comprise:

(a) from about 4% to about 8% of a substantially water-insoluble cationic fabric conditioning agent as hereinafter defined;

(b) from 0% to about 4% of a nonionic fabric conditioning agent which is an ester of a $C_{10}$ to $C_{26}$ fatty acid and a $C_1$ to $C_{12}$ mono- or polyhydric alcohol;

(c) from about 0.3% to about 0.8% of a di-polyethoxy mono-hydrocarbyl amine having the formula

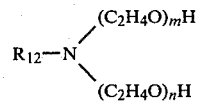

wherein $R_{12}$ is a mixture of alkyl and alkenyl groups containing from about 14 to about 20 carbon atoms (preferably from about 16 to about 20) with an average number of double bonds per molecule of from about 0.2 to about 0.7; and the sum of m plus n is from about 10 to about 25, where m and n are each numbers greater than 1; and (d) from about 0.4% to about 1.5% (preferably from about 0.6% to about 1.0%) of a water-soluble quaternary ammonium surfactant of the formula

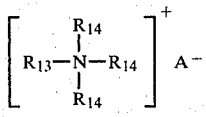

wherein $R_{13}$ is an alkyl or alkenyl radical containing from about 12 to about 20 carbon atoms, each $R_{14}$ is an alkyl radical containing from 1 to 3 carbon atoms, and $A^-$ is a water solubilizing anion, e.g., halide, nitrate or methylsulfate; the total combined amounts of (a) and (b) being from about 4% to about 10% (preferably 4% to 8%), the weight ratio of (c) to (d) being from about 0.4:1 to about 2:1, the weight ratio of (a)+(b) to (c)+(d) being from about 3:1 to 10:1 (preferably about 3:1 to about 7:1), and the said composition having a pH of from about 3 to about 7.

Cationic Fabric Conditioning Agents

Component (a) of the compositions of the invention is a substantially water-insoluble cationic fabric conditioning agent which can be a di-long chain hydrocarbyl, di-short chain alkyl quaternary ammonium salt, or a mixture of said quaternary ammonium salt with a dihydrocarbyl diethylenetriamine-based alkoxylated amido amine quaternary. The term "substantially water-insoluble" used herein in reference to fabric conditioning agents means having a solubility in water of less than about 0.1 grams per liter at 25° C.

The substantially water-insoluble, di-long chain hydrocarbyl, di-short chain alkyl quaternary ammonium salts have the formula:

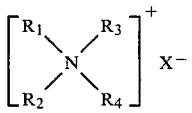

wherein $R_1$ and $R_2$ represent hydrocarbyl groups of from about 12 to 22 (preferable 16 to 22) carbon atoms; $R_3$ and $R_4$ represent alkyl groups containing from 1 to about 3 carbon atoms; X is any anion such as a halide, a $C_{2-22}$ carboxylate, or an alkyl- or arylsulf(on)ate. Examples of preferred anions include bromide, chloride, methylsulfate, toluene-, xylene-, cumene-, and benzenesulfonate, dodecylbenzenesulfonate, benzoate, parahydroxybenzoate, acetate, propionate and laurate. Representative examples of quaternary fabric conditioners include ditallow dimethyl ammonium chloride, ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methylsulfate; dihexadecyl diethyl ammonium chloride; di(coconutalkyl)dimethyl ammonium chloride. Ditallow dimethyl ammonium chloride, and di(hydrogenated tallow) dimethyl ammonium chloride are preferred.

The substantially water-insoluble dihydrocarbyl diethylenetriamine-based alkoxylated amido amine quaternaries of the compositions herein have the formula

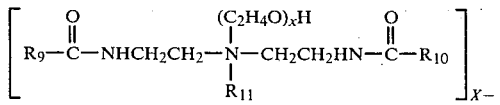

wherein $R_9$ and $R_{10}$ are $C_{12}$ to $C_{25}$ alkyl or alkenyl radicals, $R_{11}$ is a $C_1$ to $C_3$ alkyl radical, x is a number from 2 to about 5, and $X^-$ is a charge-balancing ion which has the same meaning as defined in the quaternary ammonium fabric conditioning agents above. An exemplary fabric conditioning agent of this type is $\beta\beta'$-di(hydrogenated tallowamidoethyl)-methyl polyethoxyammonium, methylsulfate. This material is sold under the name Varisoft 110 by Sherex Company. Other exemplary conditioning agents of this type are $\beta,\beta'$-di(myristylamidoethyl)-methyl polyethoxyammonium chloride, $\beta,\beta'$-di-(hexadecylamidoethyl)-methyl polyethoxyammonium acetate and $\beta,\beta'$-di(oleylamidoethyl)-methyl polyethoxyammonium bromide.

The cationic fabric conditioning agents are present in the composition herein at levels of from about 4% to about 8%. The di-long chain hydrocarbyl, di-short chain alkyl quaternary can be used as the sole conditioning agent, or it can be used in combination with the aforedescribed dihydrocarbyl diethylenetriamine-based conditioning agent. When mixtures are used, the preferred range of ratios of the former to the latter is from about 10:1 to about 1:2. The most preferred range is from about 5:1 to about 2:1.

Nonionic Fabric Conditioning Agents

In addition to the above cationic fabric conditioning agents, substantially water-insoluble nonionic fabric conditioning agents may also be present as component (b) in the compositions herein. An attractive balance between softening and antistat performance on the one hand, and cost on the other hand, can be achieved by the inclusion of the nonionic agents.

The water-insoluble nonionic fabric conditioning agents herein are the $C_{10}$–$C_{26}$ fatty acid esters of mono- or poly-hydroxy alcohols containing 1 to 12 carbon atoms. It is especially preferred that the alcohol have 1 to 8 carbon atoms, and it is preferred that the fatty acid ester has at least 1, most preferably at least 2, free (i.e., unesterified) hydroxyl groups.

The mono- or poly-hydric alcohol portion of the ester can be represented by methanol, isobutanol, 2-ethylhexanol, isopropanol, ethylene glycol and polyethylene glycol with a maximum of 5 ethylene glycol units, glycerol, diglycerol, polyglycerol, xylitol, erithritol, pentaerythritol, sorbitol or sorbitan, sugars such as glucose, fructose, galactose, mannose, xylose, arabinose, ribose, 2-deoxy ribose, sedoheptulose and sucrose. Ethylene glycol, glycerol and sorbitan esters are particularly preferred, especially the monoesters of glycerol.

The fatty acid portion of the ester normally comprises a fatty acid having from 10 to 26 (preferably 12 to 22) carbon atoms, typical examples being lauric acid, myristic acid, palmitic acid, stearic acid, arachidic acid, behenic acid, oleic acid and linoleic acid.

The glycerol esters are very highly preferred. These are the mono-, di- or tri-esters of glycerol and fatty acids of the class described above. Commercial glyceryl mono-stearate, which may contain a proportion of di- and tri-stearate, is suitable. Also useful are mixtures of saturated and unsaturated esters of glycerol derived from mixed saturated and unsaturated fatty acids.

Another very suitable group of nonionic fabric conditioning agents are the $C_{10}$ to $C_{26}$ fatty acid esters of sorbitan such as those described in Murphy et al., U.S. Pat. No. 4,085,052 issued Apr. 18, 1978. Sorbitan mono- and di-esters of lauric, myristic, palmitic, stearic, arachidic or behenic, oleic or linoleic acids are particularly useful as softening agents and can also provide antistatic benefits. Sorbitan esters are commercially available, for instance, under the trade name Span. For the purpose of the present invention, it is preferred that a significant amount of di- and tri-sorbitan esters are present in the ester mixture. Ester mixtures having from 20%–50% mono-ester, 25%–50% di-ester and 10%–35% of tri- and tetra-esters are preferred.

When used in the composition of the invention, the substantially water-insoluble nonionic fabric conditioning agents are usually present at levels of from about 1% to about 4%. The combined level of cationic fabric conditioners and nonionic fabric conditioners generally should not exceed about 10% in the composition.

Di-Polyethoxy Mono-hydrocarbyl Amine

Component (c) of the compositions herein is a dipolyethoxy mono-hydrocarbyl amine of the formula:

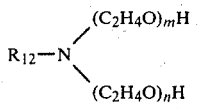

wherein $R_{12}$ is a mixture of alkyl and alkenyl groups having from about 14 to about 20 carbon atoms, preferably from about 16 to about 20 carbon atoms, with an average number of double bonds per molecule of from about 0.3 to about 0.7; and the sum (m+n) is from about 10 to about 25, preferably from about 16 to about 25, where m and n are each integers greater than 1.

The amount of di-polyethoxy mono-hydrocarbyl amine (also referred to herein simply as "ethoxylated amine") in the compositions of this invention is from about 0.3% to about 0.8%, preferably from 0.5% to 0.7%, by weight of the composition.

Di-polyethoxy mono-hydrocarbyl amine is made by ethoxylating mono-hydrocarbyl amine in a conventional manner. A preferred ethoxylated amine has a hydrocarbyl group derived from unhardened tallow and the sum (m+n) is equal to about 23. The unhardened tallow is converted to the nitrile, which is then hydrogenated to form the amine. The amine is then ethoxylated to the desired degree. This type of ethoxylated amine is commercially available from Daiichi Kogyl Seiyaku Co., Ltd. of Japan under the trade name AMILADIN-D. Another preferred ethoxylated amine made from unhardened tallow and having (m+n) equal to about 20 is VARONIC T220 sold commercially by the Sherex Company. Certain ETHOMEENS sold commercially by the Armak Company are also di-polyethoxy monoalkyl amines within the definition of component (c).

Water-Soluble Cationic Surfactant

Component (d) of the compositions herein is a water-soluble cationic surfactant having the formula:

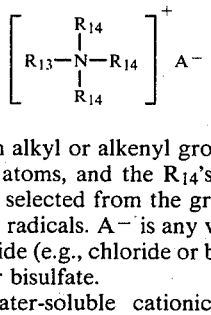

wherein $R_{13}$ is an alkyl or alkenyl group of from about 14 to 22 carbon atoms, and the $R_{14}$'s are the same or different and are selected from the group consisting of methyl and ethyl radicals. $A^-$ is any water-solubilizing anion such as halide (e.g., chloride or bromide), methylsulfate, nitrate or bisulfate.

Exemplary water-soluble cationic surfactants are tallow trimethylammonium chloride, cetyl trimethylammonium bromide, hydrogenated tallow trimethylammonium chloride, myristyl triethylammonium methylsulfate, and docosyl trimethylammonium chloride. These materials are used in the compositions herein at levels of from about 0.4% to 1.5%, preferably from about 0.6% to about 1.0%. The ratio of the alkoxylated amine to water-soluble cationic surfactant in the compositions herein is from about 0.4:1 to about 2:1, preferably from about 0.6:1 to 1:1.

In the compositions herein the combined amount of the fabric conditioning components, i.e., (a) plus (b) is from about 4% to 10% of the composition and the weight ratio of total fabric conditioning component to the combined weight of alkoxylated amine plus water-soluble cationic surfactant is from about 3:1 to about 10:1, preferably from about 3:1 to about 7:1.

Optional Components

Materials conventionally included as adjuvants in aqueous fabric conditioning compositions can be included in the composition herein. Such adjuvants include dyes, perfumes, lower alcohols, such as ethanol, methanol or isopropanol, optical brighteners, chelating agents such as tetrasodium salt of ethylene diamine tetracetate, nonionic surfactants, such as ethoxylated fatty alcohols wherein the alcohol moiety is a $C_{10}$–$C_{22}$ fatty alcohol and the number of ethoxy groups is from 3 to 20, preservatives, and ironing aids such as silicones.

The compositions herein should have a pH of from about 3 to 7. Accordingly, pH adjustment agents such as citric acid, benzoic acid, hydrochloric acid, sodium hydroxide or sodium carbonate may have to be added to the compositions to adjust pH to the desired level.

The water used to prepare the compositions herein should preferably be softened or deionized water.

Composition Preparation

The liquid fabric conditioning compositions of the present invention can be prepared by conventional methods. Homogenizing is not necessary. A convenient and satisfactory method is to prepare a melted premix of the fabric conditioning agents, alkoxylated amine, water-soluble cationic surfactant and dye (if used) at a temperature up to about 150° F. This premix is then added to a warm aqueous solution of the other ingredients. Temperature-sensitive optional components can be added after the fabric conditioning composition is cooled to room temperature or thereabouts.

For compositions containing a nonionic fabric conditioning agent, the alkoxylated amine is preferably incorporated into the warm aqueous solution of other ingredients rather than in the melted premix. The nonionic conditioning agent should be incorporated into the melted premix.

Composition Use

The liquid fabric conditioning compositions of this invention are used by addition to the rinse cycle of conventional home laundry operations. Generally, rinse water has a temperature of from about 5° C. to about 60° C. The concentration of the fabric conditioners of this invention (components (a)+(b)), is generally from about 2 ppm to about 200 ppm, preferably from about 10 ppm to about 100 ppm, by weight of the aqueous rinsing bath.

The invention will be illustrated by the following examples.

EXAMPLE I

In the freeze-thaw experiments which follow, the following test procedures are used. Testing is done on four samples of each formula. All viscosity measurements are taken on a Brookfield Model LVF Viscometer.

A. Freezing: 175 ml of the composition is poured into each of four 8 oz. tall-style ($4\frac{1}{4}$ inch$\times 2\frac{3}{8}$ inch) jars, which are then capped tightly, and placed on the shelf or a wire rack in a 0° F. constant temperature room. Samples are separated from each other by at least 2" and left without disturbance for 24 to 28 hours.

B. Thawing: The frozen samples are transferred from the 0° F. constant temperature room to a 70° F. room and placed on a wire rack separated from each other by at least three inches. The samples are left for 24 hours without disturbance. A viscosity determination is then made using the viscometer spindle which provides the highest sensitivity (smallest multiplier or factor) possible for the viscosity range being examined. This is referred to as the "70° F. thawed viscosity."

C. Thawed and Shaken Viscosity: After the 24 hour thaw period in B, the 8 oz. jar containing the sample is held in one hand and vigorously shaken for 15 seconds. Viscosity is then measured within an hour of shaking using the spindle which provides the highest sensitivity (smallest multiplier or factor) possible for the viscosity range being examined.

D. Viscosity of Thawed and Shaken Product after Re-equilibration:

The sample from C is allowed to equilibrate at 70° F. for an additional 24 hours and the viscosity of the product is measured with as little mechanical disturbance is possible using the spindle which provides the greatest sensitivity for the viscosity range involved.

E. Viscosity After Heating to 90° F. and Re-equilibrating at 70° F.:

Samples from test D (viscosity after 70° F. thaw, shaking and re-equilibrating) are placed in a 120° F. water bath. The ratio of 120° F. bath water to product volume should be at least 4:1, with the sample jars randomly and uniformly distributed in the bath. The temperature of several samples located at different points in the bath is checked by placing a thermometer in the center of the sample with as little disturbance of the sample as possible. When the temperature of each is 90±1° F., the samples are removed from the bath quickly. The samples are shaken vigorously for 15 seconds and set aside until all samples have been shaken. Viscosity readings can be taken at this point if desired.

The samples are then placed in the 70° F. constant temperature room to equilibrate for 24 hours. The viscosities are then determined with as little mechanical disturbance as possible using the spindle which provides the greatest sensitivity for the viscosity range involved. The results are recorded as the "viscosity after heating to 90° F., shaking and re-equilibrating at 70° F.".

F. Sieve Pour Test: This measures the uniformity, homogeneity, and pourability of recovered product. In this example, it was applied to product which had been heated to 90° F., shaken and re-equilibrated at 70° F. for 24 hours (i.e., product from E, above). A No. 35 USA Standard Testing Sieve is placed over a dry tared 250 ml beaker. A 4 inch length of 2 inch i.d. clean, rigid, plexiglass tubing with square, smooth-cut ends is placed on its end on the screen over the center of the beaker opening. 50 g of the product to be tested is weighed into a plastic cup or disposable beaker and transferred to the plastic tube. A product which can meaningfully be tested by this method should flow from the cup into the tube by gravity and leave less than 2 g. in the cup after the transfer has been completed.

A timer is started as the product reaches the screen during the transfer. When the timer indicates a lapsed time of 2 minutes, the product on the underside of the screen is scraped into the beaker as the screen is quickly removed from the beaker. The beaker and product are weighed, the tare weight is subtracted, and "weight of product passing through the screen in 2 minutes" is recorded. The weight is converted to the equivalent percent of the 50 gram sample taken for the test.

EXAMPLE I

The following formulas were prepared and subjected to the above tests. The ingredient amounts in the table are in weight percent.

TABLE I

| Formula Number | 1 | 2 | 3 | 4 | 5 | 6 | 7 | 8 | 9 |
|---|---|---|---|---|---|---|---|---|---|
| DTDMAC[a] | 4.4 | 4.6 | 4.6 | 4.6 | 4.05 | 4.05 | 4.05 | 4.05 | 3.68 |
| Varisoft 110[b] | | | | | 1.0 | 1.0 | 1.0 | 1.0 | 1.4 |
| Varisoft 445[c] | | | | | | | | | |
| MTTMAC[d] | 0.4 | 0.9 | 0.4 | 0.9 | 0.35 | 0.85 | 0.35 | 0.85 | 0.32 |
| GMS[e] | | | | | | | | | |
| Varonic T220[f] | | | 0.5 | 0.5 | | | 0.5 | 0.5 | |
| Varonic T205[g] | | | | | | | | | |
| Varonic T230[h] | | | | | | | | | |
| Stearyl $(EO)_{20}$ Amine | | | | | | | | | |
| Stearyl $(EO)_{30}$ Amine | | | | | | | | | |
| Coconut $(EO)_{15}$ Amine | | | | | | | | | |
| $H_2O$ + misc. to 100 | | | | | | | | | |

| Formula Number | 10 | 11 | 12 | 13 | 14 | 15 | 16 | 17 | 18 |
|---|---|---|---|---|---|---|---|---|---|
| DTDMAC[a] | 3.68 | 3.86 | 3.86 | 3.86 | 3.86 | 4.05 | 4.05 | 4.05 | 4.05 |
| Varisoft 110[b] | 1.4 | | | | | 1.0 | 1.0 | 1.0 | 1.0 |
| Varisoft 445[c] | | 2.8 | 2.8 | 2.8 | 2.8 | | | | |
| MTTMAC[d] | 0.82 | 0.84 | 1.04 | 0.34 | 0.69 | 0.85 | 0.85 | 0.85 | 0.85 |
| GMS[e] | | | | | | | | | |
| Varonic T220[f] | 0.5 | 0.5 | 0.7 | | 0.70 | | | | |
| Varonic T205[g] | | | | | | 0.5 | | | |
| Varonic T230[h] | | | | | | | 0.5 | | |
| Stearyl $(EO)_{20}$ Amine | | | | | | | | 0.5 | |
| Stearyl $(EO)_{30}$ Amine | | | | | | | | | 0.5 |
| Coconut $(EO)_{15}$ Amine | | | | | | | | | |
| $H_2O$ + misc. to 100 | | | | | | | | | |

| Formula Number | 19 | 20 | 21 | 22 | 23 | 24 | 25 | 26 | 27 | 28 | 29 |
|---|---|---|---|---|---|---|---|---|---|---|---|
| DTDMAC[a] | 4.05 | 4.05 | 4.05 | 4.23 | 4.23 | 4.23 | 4.23 | 4.05 | 4.05 | 4.05 | 4.05 |
| Varisoft 110[b] | 1.0 | 1.0 | 1.0 | | | | | 1.0 | 1.0 | 1.0 | 1.0 |
| Varisoft 445[c] | | | | | | | | | | | |
| MTTMAC[d] | 0.85 | 0.85 | 0.85 | 0.37 | 0.87 | 0.37 | 0.87 | 0.35 | 0.60 | 0.35 | 0.60 |
| GMS[e] | | | | 2.3 | 2.3 | 2.3 | 2.3 | | | | |
| Varonic T220[f] | | | | | | 0.6 | 0.6 | | | 0.6 | 0.6 |

TABLE I-continued

| | | | |
|---|---|---|---|
| Varonic T205[g] | | | |
| Varonic T230[h] | | | |
| Stearyl $(EO)_{20}$ Amine | 0.5 | | |
| Stearyl $(EO)_{30}$ Amine | | 0.5 | |
| Coconut $(EO)_{15}$ Amine | | | 0.5 |
| $H_2O$ + misc. to 100 | | | |

[a]Di(hydrogenated tallow)dimethylammonium chloride*
[b]β,β'-di(tallowamidoethyl)-methylpolyethoxy-ammonium methylsulfate. Sherex Company.
[c]Believed to be 1-methyl-1-tallow-amidoethyl-2-tallow imidazolinium methylsulfate. Sherex Company.
[d]Hydrogenated-tallowtrimethylammonium chloride
[e]40% Glyceryl monostearate; 40% monoester, 60% di- and triesters
[f]$(POE)_{20}$ tallowamine
[g]$(POE)_5$ tallowamine
[h]$(POE)_{30}$ tallowamine
*The commercial sample of DTDMAC used in these formulas contained about 69% DTDMAC and 6% MTTMAC. This fact was taken into account in calculating the percentages of DTDMAC and MTTMAC in the formulas of this example.

The formulas were prepared in the following manner:

The appropriate fabric conditioning agents (DTDMAC, Varisoft 110, Varisoft 445 and/or GMS and freeze/thaw recovery agents (MTTMAC and ethoxylated hydrocarbyl amines) were melted and combined in the formula proportions (by weight) for a 2.0 Kg. batch. The combination was placed on a magnetic-stirring hotplate and heated and stirred in a covered beaker. The dye solution was added during this period, and when the temperature reached 155° F. it was removed from the hotplate.

A water seat was prepared by weighing the appropriate quantity of warm deionized water and adding enough preservative to give a final concentration of 600 ppm preservative in the final product. This solution was brought to 110° to 112° F. on a stirring hotplate and transferred to the main mix tank which was equipped with baffles, a turbine-type agitator, and a delivery tube fitted with a stopcock and a long stem curved at the tip to deliver the premix into the tips of the agitator turbine blades. The premix was transferred to the delivery tube at a temperature between 145° and 155° F., the main-mix agitator, (preset to run at 800 rpm) was started and the premix addition was started and adjusted to a steady rate such that the delivery was completed in three to five minutes. Stirring was continued for one minute after completion of premix addition. At this point, the perfume was added at a fast dropwise rate, and the final mix was agitated for another minute after all of the perfume was added.

Alternatively, it is advantageous for achieving maximum effectiveness or phase stability for certain formulas to add the ethoxylated hydrocarbyl amine to the water seat (dissolve) or to post-add it to the main mix immediately after the premix (and before the perfume). In two cases (formulas 19 and 20) the ethoxylated hydrocarbyl amines were predissolved in the water seat prior to addition of the premix.

Freeze-thaw recovery results obtained on the compositions of Table I are shown in Table II:

TABLE II

| Formula | 70° F. Thawed Viscosity Test B | 70° Shaken Viscosity Test C | 70° Viscosity After Re-equilibration Test D | Viscosity after Heating to 90° F. and Re-equilibrating to 70° F. Test E | Sieve-Pour (% Through Screen) Test F |
|---|---|---|---|---|---|
| 1 | 2000 | 1492 | 1658 | 1883 | 51% |
| 2 | 4575 | 2692 | 2592 | 4202 | 4.6 |
| 3 | 2258 | 2258 | 2675 | 2448 | 66 |
| 4 | 935 | 1290 | 1333 | 722 | 97 |
| 5 | 2213 | 1670 | 1678 | 1644 | 62 |
| 6 | 4963 | 2363 | 2200 | 3025 | 25 |
| 7 | 2150 | 1640 | 1640 | 1421 | 73 |

TABLE II-continued

| Formula | 70° F. Thawed Viscosity Test B | 70° Shaken Viscosity Test C | 70° Viscosity After Re-equilibration Test D | Viscosity after Heating to 90° F. and Re-equilibrating to 70° F. Test E | Sieve-Pour (% Through Screen) Test F |
|---|---|---|---|---|---|
| 8 | 1315 | 1355 | 1410 | 1636 | 71 |
| 9 | 3025 | 1513 | 1488 | 1560 | 58 |
| 10 | 1063 | 1230 | 1278 | 1352 | 82 |
| 11 | 3613 | 3938 | 3713 | 6063 | 0 |
| 12 | 8700 | 7850 | 8125 | 6113 | 0 |
| 13 | 6350 | 5013 | 5525 | 4375 | 5.4 |
| 14 | 1725 | 2638 | 2775 | 3988 | 34 |
| 15 | 5063 | 4488 | 5000 | 4288 | 4.6 |
| 16 | 3875 | 2975 | 2950 | 3138 | 58 |
| 17 | 2950 | 2625 | 2475 | 1335 | 85 |
| 18 | 3888 | 2888 | 2888 | 2775 | 55 |
| 19 | 3888 | 2350 | 2563 | 2525 | 95 |
| 20 | 4075 | 2850 | 3188 | 2625 | 72 |
| 21 | 1938 | 2550 | 2438 | 2888 | 63 |
| 22 | 6900 | 4213 | 4050 | 1250 | 80 |
| 23 | 6250 | 5850 | 6188 | 960 | 88 |
| 24 | 4163 | 1660 | 1870 | 305 | 98 |
| 25 | 1225 | 1025 | 1140 | 335 | 98 |
| 26 | 2113 | 1995 | 1815 | 1550 | 71 |
| 27 | 4275 | 2150 | 1710 | 2385 | 51 |
| 28 | 1625 | 1540 | 1575 | 1910 | 72 |
| 29 | 1105 | 1375 | 1373 | 1780 | 85 |

Formulas 4, 8, 10, 25 and 29 are within the scope of the invention. The data for the individual tests, in general, demonstrate that each of these five formulas exhibits freeze-thaw recovery which is superior to that of formulas which contain cationic softening agents, ethoxylated amines, and/or ratios of the freeze-thaw ingredients which are outside the scope of the present invention.

EXAMPLE II

A composition of the present invention, utilizing only cationic materials as the fabric conditioning agents is made according to the following formula:

| | |
|---|---|
| Di (hydrogenated tallow)dimethylammonium chloride (DTDMAC) | 4.05% |
| β,β'-di-(tallowamidoethyl)-methyl (polyethoxy) hydroxy-ethylammonium methylsulfate (Varisoft 110) | 1.0% |
| Hydrogenated-tallow trimethylammonium chloride (MTTMAC) | 0.85% |
| Polyoxyethylene (20) tallowamine | 0.5% |
| Dye (Polar Brilliant Blue) | 0.003% |
| Preservative | 0.06% |
| Perfume | 0.25% |
| Water (deionized) | to 100% |

The composition is prepared by melting the DTDMAC and Varisoft 110, at a temperature below 150° F. and mixing them together, along with the appropriate quantities of MTTMAC and polyoxyethylene (20) tallowamine. The dye (as a 1.35% solution in water) is also added to this premix and the temperature of the premix is maintained at about 140°-145° F., with stirring. The water and preservative are heated in a mix-tank to about 110°-115° F. The melted premix is then gradually added to the aqueous solution in the mix tank. Mixing is continued for about one minute after the premix addition is complete. Perfume is then added over a period of one minute with continued mixing. Mixing is then continued for about one minute after perfume addition is complete. The composition is then cooled to room temperature.

EXAMPLE III

A composition of the present invention, utilizing cationic and nonionic fabric conditioning agents is made according to the following formula:

| | |
|---|---|
| Di (hydrogenated tallow)dimethylamnium chloride | 4.23% |
| Glycerylmonostearate (40%)* | 2.3% |
| Hydrogenated-tallowtrimethylammonium Chloride (MTTMAC) | 0.87% |
| Polyoxyethylene (20) tallowamine | 0.6% |
| Preservative | 0.06% |
| Perfume | 0.25% |
| Dye (Polar Brilliant Blue) | 0.004% |
| Water (deonized) | to 100% |

*A mixture of glycerides consisting of 40% glyceryl monostearate and 60% di- and tristearates.

The making procedure is the same as in Example II, except that the glyceryl monostearate is incorporated into the melted premix.

What is claimed is:

1. An aqueous fabric conditioning composition comprising, by weight:

(a) from about 4% to about 8% of a substantially water-insoluble cationic fabric conditioning agent selected from the group consisting of:

(i) quaternary ammonium salts having the formula

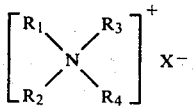

wherein $R_1$ and $R_2$ represent alkyl or alkenyl groups of from about 12 to 22 carbon atoms, $R_3$ and $R_4$ represent alkyl groups containing from 1 to about 3 carbon atoms and $X^-$ is a charge-balancing anion; and mixtures of (i) with (ii) dihydrocarbyldiethylenetriamine based alkoxylated amido amine quaternary salts of the formula

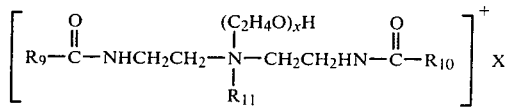

wherein $R_9$ and $R_{10}$ are $C_{12}$ to $C_{25}$ alkyl or alkenyl radicals, $R_{11}$ is a $C_1$ to $C_3$ alkyl radical, x is a number from 2 to about 5, and $X^-$ is a charge-balancing anion;

(b) from 0% to about 4% of a nonionic fabric conditioning agent which is an ester of a $C_{10}$ to $C_{26}$ fatty acid and a $C_1$ to $C_{12}$ mono- or polyhydric alcohol;

(c) from about 0.3% to about 0.8% of a di-polyethoxy mono-hydrocarbyl amine having the formula

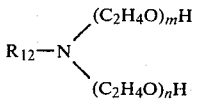

wherein $R_{12}$ is a mixture of alkyl and alkenyl groups containing from about 10 to about 20 carbon atoms, wherein the average number of double bonds per molecule is from about 0.2 to about 0.7, wherein the sum of m plus n is from about 10 to about 25, and wherein m and n are each numbers greater than 1; and (d) from about 0.4% to about 1.5% of a water-soluble quaternary ammonium surfactant of the formula

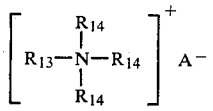

wherein $R_{13}$ is an alkyl or alkenyl radical contaning from about 12 to about 20 carbon atoms, each $R_{14}$ is an alkyl radical containing from 1 to 3 carbon atoms, and $A^-$ is a water solubilizing anion; the total combined amounts of (a) and (b) being from about 4% to about 10%, the weight ratio of (c) to (d) being from about 0.4:1 to about 2:1, the weight ratio of (a)+(b) to (c)+(d) being from about 3:1 to 10:1, and the said composition having a pH of from about 3 to about 7.

2. The composition of claim 1, wherein in mixtures of (a) (i) and (a) (ii) the weight ratio of (a) (i) to (a) (ii) is from about 5:1 to 2:1.

3. The composition of claim 1, wherein component (b) is an ester selected from the group consisting of $C_{10}$ to $C_{26}$ fatty acid mono-, di-, and tri- esters of glycerine and the $C_{10}$ to $C_{26}$ fatty acid mono-, di-, and tri- and tetra esters of sorbitan, and mixtures of said esters.

4. The composition of claim 3, wherein the combined amounts of components (a) and (b) is from about 4% to about 8% by weight.

5. The composition of claim 4, wherein the weight ratio of components (a)+(b) to (c)+(d) is from about 3:1 to about 7:1.

6. The composition of claim 5, wherein component (a) is a mixture of di(hydrogenated tallow)dimethylammonium chloride and di(tallowamidoethyl)-methyl(-polyethoxy)ammonium methylsulfate in a weight ratio of from about 5:1 to about 2:1.

7. The composition of claim 5, wherein component (a) is di(hydrogenated tallow)dimethylammonium chloride and component (b) is a mixture of stearic acid esters of glycerine wherein the amount of glyceryl monostearate is about 40% by weight.

* * * * *